US005079891A

United States Patent [19]

Paris

[11] Patent Number: 5,079,891

[45] Date of Patent: Jan. 14, 1992

[54] BIDIMENSIONAL TRUSS STRUCTURE, PARTICULARLY SUPPORT FOR OVERHEAD ELECTRIC ENERGY TRANSMISSION LINES

[75] Inventor: Luigi Paris, Rome, Italy

[73] Assignee: SAE Sadelmi S.p.A., Milan, Italy

[21] Appl. No.: 551,480

[22] Filed: Jul. 12, 1990

[30] Foreign Application Priority Data

Jul. 14, 1989 [IT] Italy ..... 21192 A/89

[51] Int. Cl.[5] ..... E04C 3/06; E04H 12/08

[52] U.S. Cl. ..... 52/650; 52/694; 174/45 R

[58] Field of Search ..... 174/45 R; 52/694, 693, 52/721, 648, 732, 697, 40, 650

[56] References Cited

U.S. PATENT DOCUMENTS

| | | | |
|---|---|---|---|
| 1,762,112 | 6/1930 | White | 52/694 |
| 1,880,000 | 9/1932 | Wallen . | |
| 2,284,898 | 6/1992 | Hartman | 52/650 |
| 2,315,687 | 4/1943 | Burke | 52/694 |
| 2,996,160 | 8/1961 | Voight | 52/694 |
| 4,646,505 | 3/1987 | Paris | 52/648 |

FOREIGN PATENT DOCUMENTS

| | | | |
|---|---|---|---|
| 213037 | 1/1961 | Austria | 52/694 |
| 0177634 | 4/1986 | European Pat. Off. . | |
| 391266 | 8/1965 | Switzerland | 52/694 |

OTHER PUBLICATIONS

"Colorado-UTE's 345 kV Steel Latticed H Frame Line Designed as a Structural System", *IEEE Transactions on Power Apparatus and Systems*, vol. 101, No. 10, Oct. 1982, by H. Sansom et al., pp. 4069-4078.

*Primary Examiner*—John E. Murtagh
*Attorney, Agent, or Firm*—Young & Thompson

[57] ABSTRACT

A bidimensional support or tower for overhead electric energy transmission lines is formed of a flat truss structure, the stringers of which consist of at least one truss beam comprising a pair of cold-bent channel sections connected together, with their cavities facing, by means of a zigzag-bent steel rod applied by welding to the flanges of said sections. Said tower comprises two stringers connected by one or more horizontal girders, which stringers can be vertical and parallel, or else converging towards the top substantially in correspondence of the point where the loads are applied, in which latter case a vertical structural element is provided above said point. Said stringers and said vertical structural element are formed of said truss beams, positioned either singly or side-by-side.

3 Claims, 5 Drawing Sheets

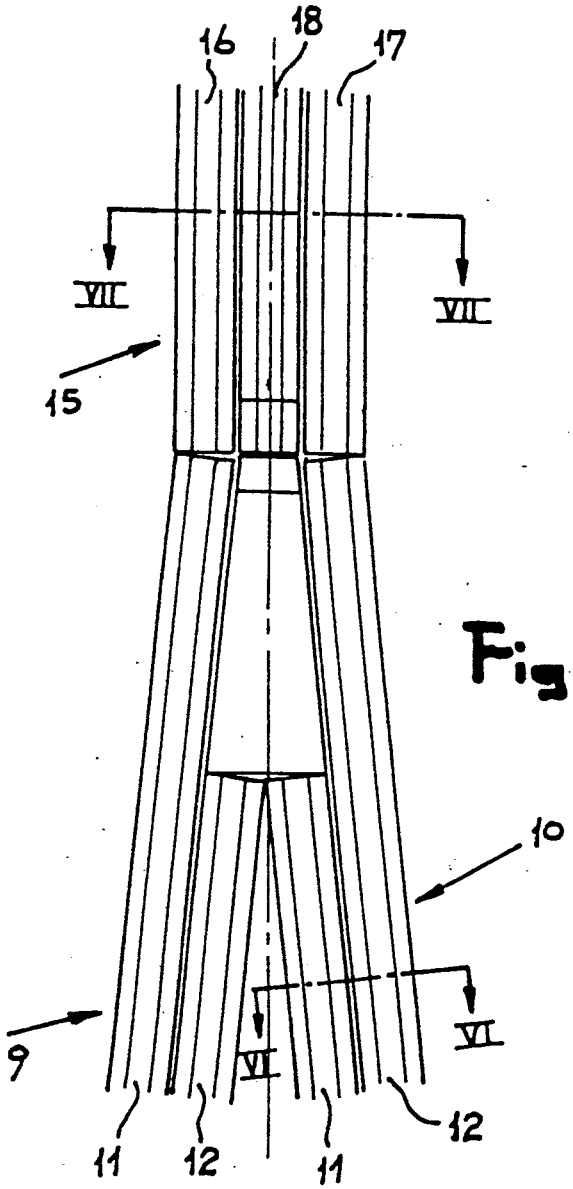
Fig. 5
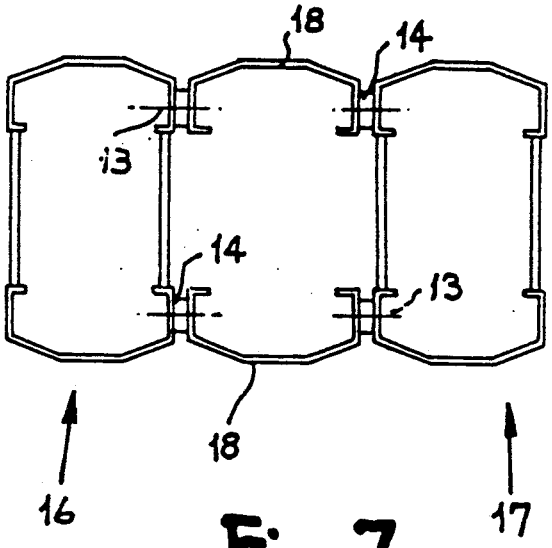
Fig. 7
Fig. 6
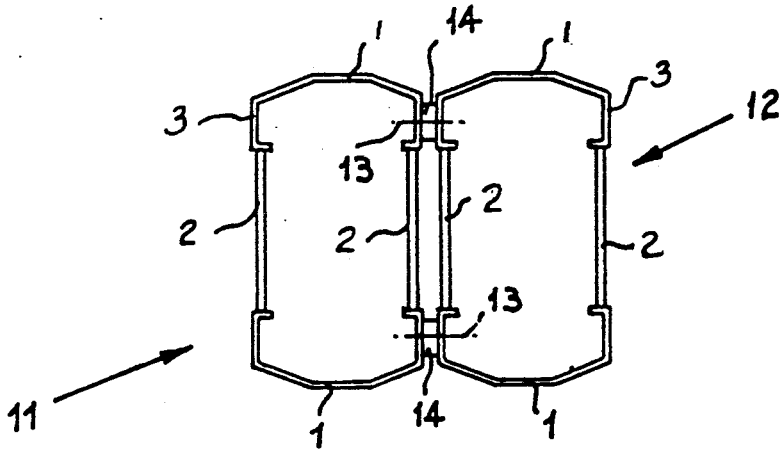

BIDIMENSIONAL TRUSS STRUCTURE, PARTICULARLY SUPPORT FOR OVERHEAD ELECTRIC ENERGY TRANSMISSION LINES

BACKGROUND OF THE INVENTION

The present invention refers to flat truss structures, especially designed to form bidimensional supports or towers for high-voltage overhead electric energy transmission lines.

There are already known to be, from EP-A1-177 634, very convenient truss structures to form supports for overhead electric energy transmission lines: these structures are particularly slender and the lateral deviations of the compressed stringer, outside the plane containing said structures, are at the same time very contained, as is required to prevent risks of failure. These truss structures are formed with stringers consisting of structural elements having a high torsional rigidity, which is less than that of tubular structural elements (tubes), but more than that of open structural elements (angles) normally used to construct the supports or towers in question. They hence allow to reach a perfect compromise between the numerous advantages provided by the use of angles and an improved behaviour against stresses which is typical of tubes.

SUMMARY OF THE INVENTION

It has now been found that further important improvements, from the point of view of torsional rigidity, accompanied by significant advantages from the economical and constructive point of view, can be obtained by realizing the stringers of large flat truss structures—designed to form bidimensional supports or towers for overhead electric energy transmission lines—with structural elements consisting of at least one substantially tubular truss beam, formed of a pair of cold-bent channel sections connected together, with their cavities facing, by way of a zigzag-bent steel rod applied by welding to the flanges of said sections.

Stringers of this type, as well as providing—due to their excellent characteristics of torsional rigidity—the truss structures of these towers with a high resistance to stresses, are also very convenient to produce, as they consist of repetitive modular structural elements which are easy and economic to assemble and which can be obtained also with plants and equipment making use of robots.

In the flat truss structure according to the invention, each stringer can be formed of a single truss beam—as indicated heretofore—or of two or more of said truss beams, positioned side-by-side and connected together either directly and/or with the cooperation of further components, like known type sections. In the second case, the truss beams forming the stringers are connected together by means of bolts, with the interposition of spacing blocks.

The invention also concerns the supports or towers for overhead electric energy transmission lines, consisting of flat truss structures the stringers of which have the above defined characteristics.

A first type of these towers is characterized in that, its lower part is formed of two stringers connected by one or more horizontal girders and converging towards the top, substantially in correspondence of the point where the loads are applied, and its part above said point is formed of a vertical structural element obtained by placing side-by-side two truss beams equal to those which form said stringers.

A second type of these towers is characterized in that, its lower part is formed of two stringers connected by one or more horizontal girders and converging towards the top, substantially in correspondence of the point where the loads are applied, and its part above said point is formed of a vertical structural element obtained by placing side-by-side two truss beams, equal to those which form said stringers and connected together by intermediate sections. In this tower, said intermediate sections preferably consist of channel sections equal to those used to form said truss beams.

A third type of these towers is formed with parallel stringers, connected at the top by a horizontal cross arm and, at an intermediate height, by parallel or intersecting girders.

BRIEF DESCRIPTION OF THE DRAWINGS

The invention will now be described in further detail, by mere way of example, with reference to the accompanying drawings, in which:

FIG. 5 is an elevation view—on an enlarged scale in respect of FIG. 2—showing the central part of a second embodiment of a tower according to the invention;

FIGS. 6 and 7 are enlarged scale cross section views, along the lines VI—VI and VII—VII of FIG. 5, showing the lower stringers and, respectively, the upper structural element, forming the tower of FIG. 5.

DESCRIPTION OF THE PREFERRED EMBODIMENTS

With reference to the accompanying drawings, a description is given first of all of the type of truss beam used to form the stringers and other structural elements of the towers according to the invention.

Figure 1:
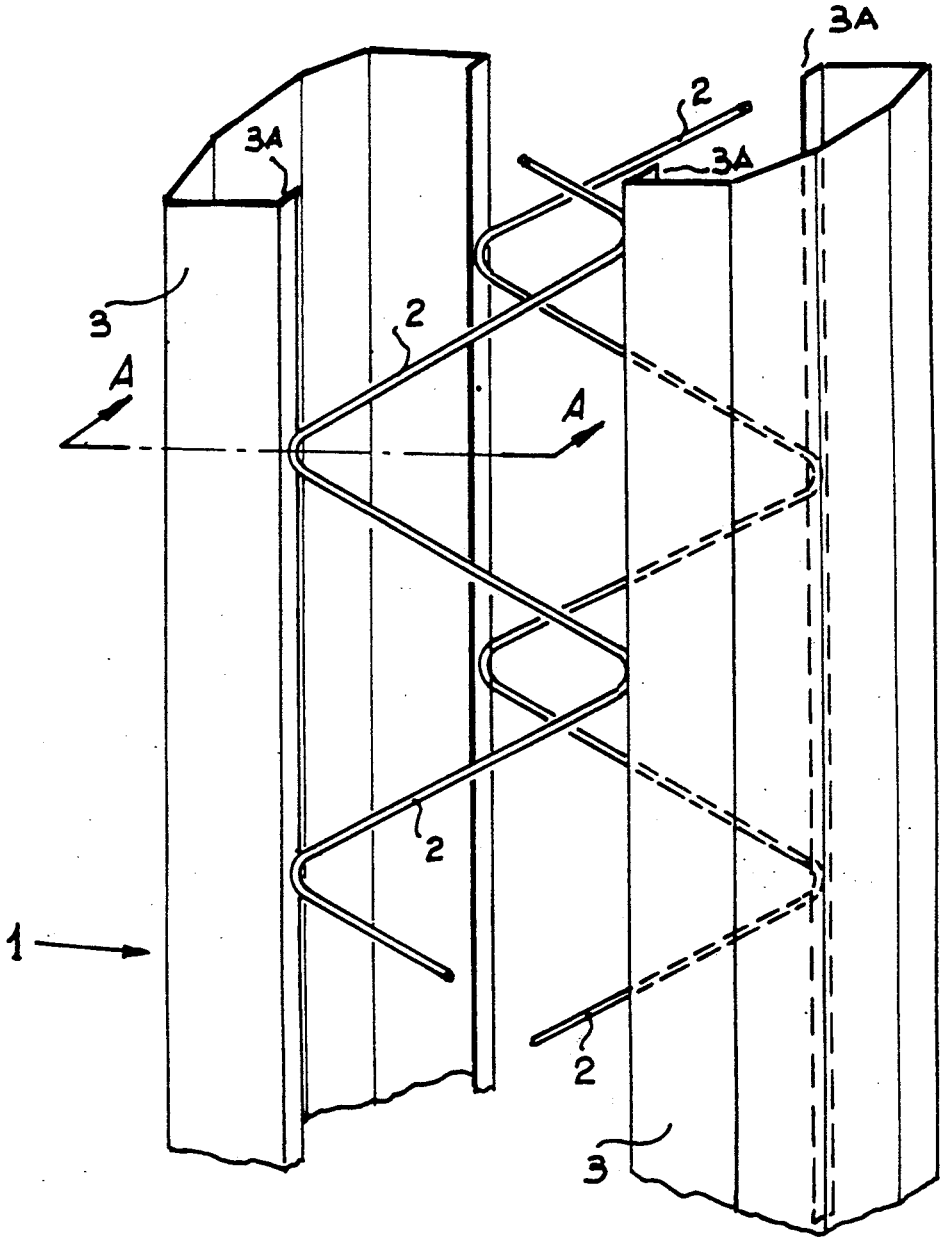
FIG. 1 is a perspective assembly view of the truss beam used to form the stringers of the flat truss structure according to the invention.
Figure 1A:
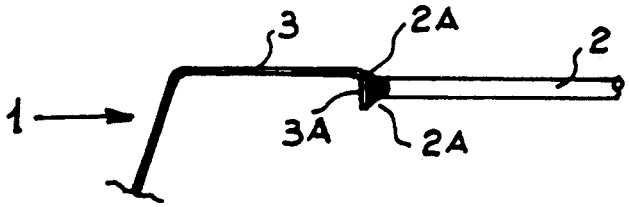
FIG. 1A is an enlarged scale cross section view, along the line A—A of FIG. 1, showing the detail of the welding connection between the steel rod and the truss beam of FIG. 1.

Said beam—illustrated in FIGS. 1 and 1A—comprises, in known manner, a pair of cold-bent channel sections 1, connected together—with their cavities facing each other—by way of a zigzag-bent steel rod 2, applied by welding 2A onto the edges 3A of both flanges 3 of the channel sections 1. As also known, this truss beam has a high torsional rigidity and can very conveniently be produced even with highly automated equipment and processes.

In the truss structure according to the present invention, said truss beam is used to form both the lower stringers and the upper structural elements of the towers for overhead electric energy transmission lines.

Figure 2:
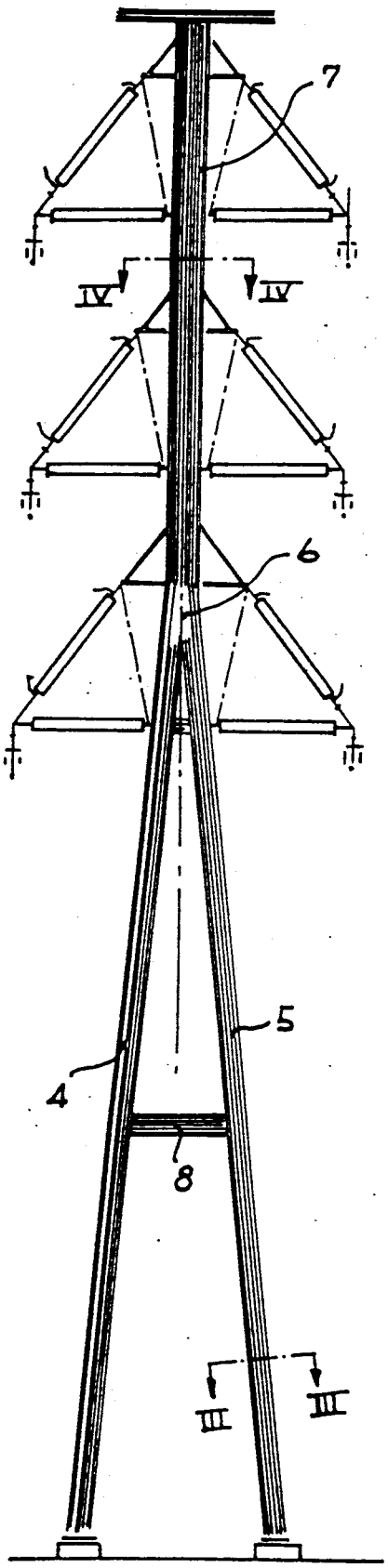
FIG. 2 is an elevation view of a first embodiment of a support or tower according to the invention.

Thus, the tower shown in FIG. 2 comprises, in its lower part, two stringers 4 and 5 converging towards the top substantially into a point 6 where the loads are applied, and in its upper part above said point 6, a single vertical structural element 7. The two stringers 4 and 5 are connected by a horizontal girder 8.

Figure 4:
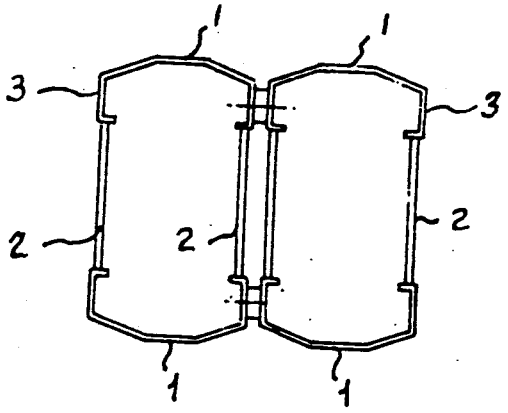
FIG. 4 is an enlarged scale cross section view, along the line IV—IV of FIG. 2, showing the vertical structural element forming the top part of the tower of FIG. 2.
Figure 3:
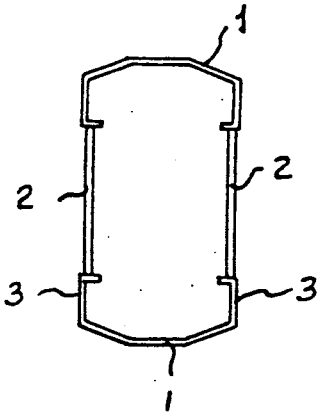
FIG. 3 is an enlarged scale cross section view, along the line III—III of FIG. 2, showing one of the stringers forming the lower part of the tower of FIG. 2.

The two stringers 4 and 5 of this tower are each formed (see the section of FIG. 3) of a single truss beam of the type shown in FIG. 1, while the structural element 7 is formed by placing side-by-side two of said truss beams (see section of FIG. 4).

The tower, the central part of which is shown in FIG. 5, is likewise formed of two lower converging stringers 9 and 10, which each consist, in this case, of two truss beams 11, 12,—as that illustrated in FIG. 1—placed side-by-side and connected together by means of bolts 13 with the interposition of spacing blocks 14 (see the section of FIG. 6); the upper vertical structural element 15 is in turn formed by positioning side-by-side two truss beams 16 and 17, similar to the previous ones, and connecting them, by way of intermediate channel sections 18 (see section of FIG. 7), by means of bolts 13 and spacing blocks 14.

It can easily be understood how the towers according to the invention are constructed in an extremely simple and convenient manner, due to the structural components adopted therein, especially the stringers formed of the truss beams of FIG. 1—which are very practical and economic to produce, also in a highly automated way—eventually combined with sections of the same type as those forming the beams, the assembly of which is easy and practical. At the same time, these towers can advantageously be formed very slender, thanks to the properties of high torsional rigidity of their structural components.

Figure 8:
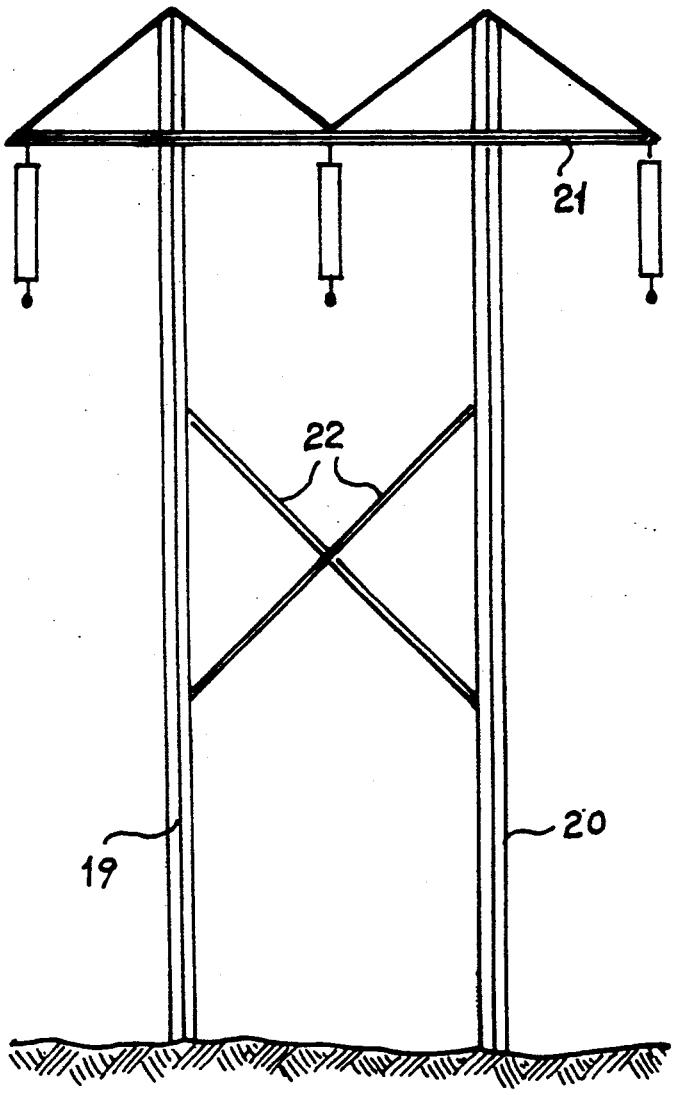
FIGS. 8 and 9 are diagrammatic elevation views of two further embodiments of the tower according to the invention.
Figure 9:
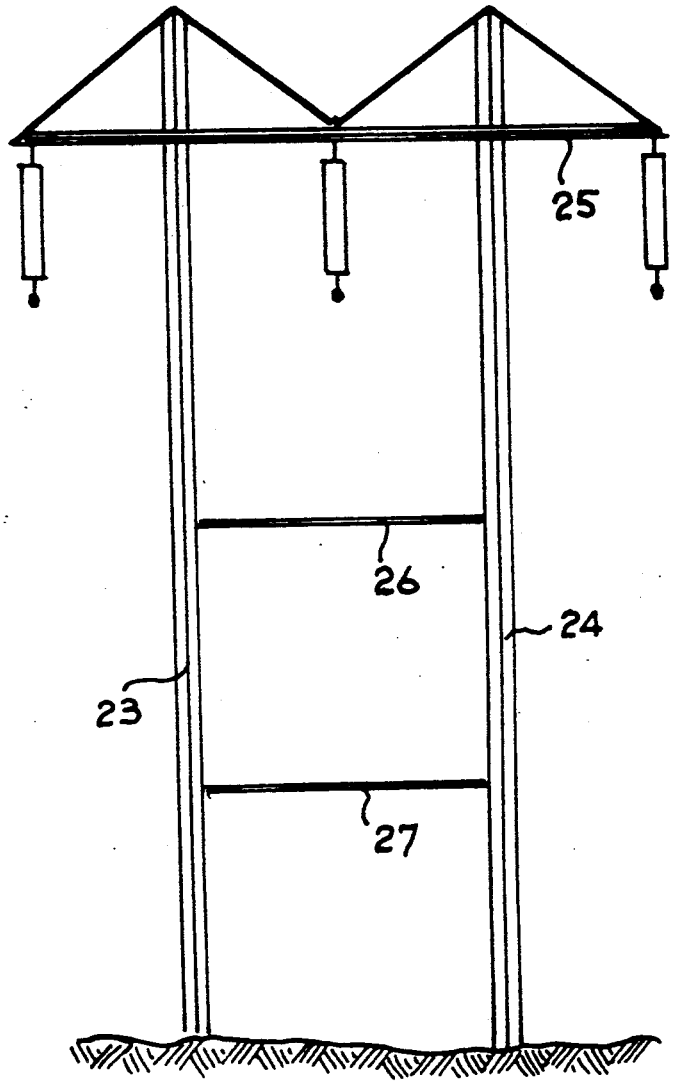

FIGS. 8 and 9 show two further embodiments of the tower according to the invention, comprising vertical parallel stringers. The tower of FIG. 8 is formed of two parallel stringers 19 and 20—consisting of truss beams as those of FIG. 1, according to the principles adopted in the stringers forming the towers of FIGS. 2 or 5—as well as of an upper horizontal cross arm 21, for suspension of the insulators, and of a central intersecting girder or bracing cross 22. The tower of FIG. 9 equally comprises two parallel stringers 23 and 24—similar to those of the tower of FIG. 8—as well as an upper horizontal cross arm 25 and two parallel intermediate girders 26 and 27. The cross arms and girders of these towers generally consist of conventional open sections.

It is understood that there may be other practical embodiments of the towers, and of the structural elements forming the same, differing from those described and illustrated heretofore, which fall within the protection scope of the present invention.

I claim:

1. Flat truss structure to form bidimensional supports or towers for overhead electric energy transmission lines, comprising a plurality of stringers forming part of said structure and each comprised by a pair of substantially tubular truss beams each formed by a pair of cold bent channel sections each having a cavity and two flanges extending in the same direction, said two flanges terminating in edges directed toward each other, two zigzag bent cylindrical steel rods each welded to one said edge of each said section, said pair of truss beams being disposed side by side with all four said zigzag bent rods disposed in a single row, spacing blocks between adjacent said flanges of said pair of truss beams, and bolts extending through said flanges and spacing blocks to secure said pair of truss beams together.

2. Truss structure as claimed in claim 1, a said bolt passing through a said flange of both of said pair of truss beams and through a said spacing block therebetween.

3. Truss structure as claimed in claim 1, and an intermediate channel section having two flanges extending in the same direction disposed between and interconnecting said pair of truss beams, a said bolt passing both through a said flange of a said channel section of a said truss beam and through a said flange of said channel section disposed between said truss beams and also through a said spacing block therebetween.

* * * * *